United States Patent [19]

Estes

[11] Patent Number: 4,730,681

[45] Date of Patent: Mar. 15, 1988

[54] ROCK BIT CONE LOCK AND METHOD

[75] Inventor: Roy D. Estes, Weatherford, Tex.

[73] Assignee: Rock Bit Industries U.S.A., Inc., Fort Worth, Tex.

[21] Appl. No.: 902,463

[22] Filed: Aug. 29, 1986

[51] Int. Cl.[4] ..... E21B 10/22; E21B 12/02

[52] U.S. Cl. ..... 175/39; 175/371; 384/96

[58] Field of Search ..... 175/39, 40, 343, 371, 175/372; 384/96, 448, 906

[56] References Cited

U.S. PATENT DOCUMENTS

| | | | |
|---|---|---|---|
| 2,885,185 | 5/1959 | Sartor | 255/313 |
| 3,207,241 | 9/1965 | Neilson | 175/340 |
| 3,381,968 | 5/1968 | Neilson | 277/95 |
| 3,489,421 | 1/1970 | Neilson | 277/95 |
| 3,581,564 | 6/1971 | Young, Jr. | 175/39 |
| 3,656,764 | 4/1972 | Robinson | 277/92 |
| 3,678,883 | 7/1972 | Fischer | 175/39 |
| 3,680,873 | 8/1972 | Garner | 277/95 |
| 3,721,306 | 3/1973 | Sartor | 175/228 |
| 3,823,789 | 7/1974 | Garner | 175/340 |
| 3,853,184 | 12/1974 | McCullough | 175/39 |
| 3,917,361 | 11/1975 | Murdoch | 308/8.2 |
| 4,006,788 | 2/1977 | Garner | 175/330 |
| 4,021,084 | 5/1977 | Garner | 308/8.2 |
| 4,061,376 | 12/1977 | Villaloboz | 308/8.2 |
| 4,067,406 | 1/1978 | Garner et al. | 175/341 |
| 4,068,731 | 1/1978 | Garner et al. | 175/339 |
| 4,150,728 | 4/1979 | Garner et al. | 175/374 |
| 4,161,223 | 7/1979 | Oelke | 175/228 |
| 4,181,377 | 1/1980 | Oelke | 308/8.2 |
| 4,185,706 | 1/1980 | Baker, III et al. | 175/340 |
| 4,189,014 | 2/1980 | Allen et al. | 175/339 |
| 4,193,464 | 3/1980 | Dixon | 175/364 |
| 4,204,437 | 5/1980 | Espana | 76/108 |
| 4,235,295 | 11/1980 | Zyglewyz | 175/372 |
| 4,276,946 | 7/1981 | Millsapps, Jr. | 175/228 |

*Primary Examiner*—Stephen J. Novosad
*Assistant Examiner*—Terry Lee Melius
*Attorney, Agent, or Firm*—L. Dan Tucker

[57] ABSTRACT

A cutting cone on a rotary rock bit is captively retained on a journal pin by an annular array of ball bearings disposed in laterally facing annular races formed in the cone and pin. When a predetermined amount of surface wear has occurred between the cone and pin as the bit is operated, one or more of the balls is caused to axially shift into and become trapped in a small lockup grooved formed in the journal pin and communicating with its race. Other balls become wedged between the trapped balls and the cone, thereby rotationally locking the cone on its pin and preventing further pin-cone surface wear which might otherwise cause cone loss. During operation of the bit, the locked cone produces a readily detectable increase in rotary table torque, and a decrease in bit penetration rate, thereby signalling the driller that the bit needs replacement.

25 Claims, 5 Drawing Figures

ROCK BIT CONE LOCK AND METHOD

BACKGROUND OF THE INVENTION

The present invention relates to an improved earth boring rotary rock bit in which wear-induced cone loss is prevented by automatically causing a rotational lockup between the cone and its supporting journal pin when a predetermined degree of wear therebetween occurs.

Rotary rock bits are well known in the drilling art and typically comprise a bit body having three or more support arms depending therefrom and carrying journal pins which project downwardly and radially inwardly from the support arms. Cutting cones are coaxially supported on the journal pins for rotation relative thereto, and they are captively retained on the pins, by annular arrays of ball bearings disposed within facing annular races. Sealing means maintain lubricant in the bearing areas and prevent entry of borehole fluids and detritus therein. During rotation of the bit body within the earth the cutting cones are caused to rotate relative to their supporting journal pins to thereby perform the cutting function of the bit.

Rock bits of this general type are exemplified in U.S. Pat. Nos. 2,885,185; 3,207,241; 3,381,968; 3,489,421; 3,628,616; 3,656,764; 3,680,873; 3,721,306; 3,823,789; 3,917,361; 3,995,917; 4,006,788; 4,021,084; 4,061,376; 4,067,406; 4,068,731; 4,150,728; 4,161,223; 4,181,377; 4,185,706; 4,189,014; 4,193,464; 4,204,437 and 4,276,946.

A longstanding problem heretofore associated with conventional rock bits of this type is that when a bearing seal fails the inner surface of the cone and the loaded side of the journal pin begin to wear away, thereby progressively widening the gap between the top of the journal and the cone. At a certain point in time the width of such gap can increase to an extent such that the ball bearings can escape and permit the cone to fall off its journal pin.

This is not to say that such gap-widening in every instance causes cone separation in conventional rock bits. Sometimes the ball bearings will jam in their races and lock the cone on its journal pin before the gap widens enough to allows cone loss. However, such cone lockup in conventional rock bits is wholly a fortuitous event, and cannot be relied upon to prevent cone separation.

Cone loss must be avoided since a cone in the bottom of a drill hole can render further drilling extremely difficult, if not impossible, if the lost cone cannot be successfully fished out. The fishing-out of a separated cone is usually a laborious, time-consuming and expensive endeavor.

Heretofore, the prevention of cone loss is commonly accomplished by estimating the drilling time to which a given rock bit may be exposed, and by carefully monitoring the penetration rate, rotary torque and drill string action during this time.

The accuracy of this time estimate is unavoidably dependent upon a wide variety of factors. If this time estimate is overly conservative, unnecessary drill bit replacement costs may be incurred. On the other hand, if the time estimate is overly optimistic, and bit failure signals are not observed, cone loss can occur.

From the foregoing it can be seen that it would be highly desirable to provide improved rotary rock bit apparatus and associated drilling methods which eliminate or minimize above-mentioned and other limitations and disadvantages typically associated with rock bits of conventional construction. Accordingly, it is an object of the present invention to provide such apparatus and methods.

SUMMARY OF THE INVENTION

In carrying out principles of the present invention, in accordance with a preferred embodiment thereof, an improved rotary rock bit is provided in which wear-induced loss of any of its cutting cones is prevented by automatically causing a rotational lockup between one of the cones and its supporting journal pin in response to a predetermined degree of surface wear therebetween. The rotational lockup of one of the cones, which indicates that the rock bit has failed causes an easily detectable increase in rotary table torque and decrease in the bit's penetration rate during the drilling operation. When these "dull bit" signals are sensed, the worn bit is pulled up and replaced.

Each of the cutting cones of the bit is retained on its journal pin by an annular array of ball bearings in laterally facing annular races formed on the journal pin and within the cutting cone. Circumscribing the journal pin axially inwardly of the races is an annular floating journal bushing which serves to maintain the cone and pin in axial alignment and functions as a bearing element interposed between the surfaces of the pin and cone. An O-ring or other type of seal circumscribing the journal pin adjacent the base of the cone is used to prevent entry of bore hole fluid into the cone.

The automatic cone lockup feature of the present invention is provided by means of a lockup groove formed on the upper surface of the journal pin at the juncture of the ball race and the main journal bearing surface.

During normal operating of the rock bit, with the cone rotating on its journal pin, the ball bearings are maintained in the pin and cone races, function in a conventional manner, and cannot enter the groove.

However, when a seal fails the upward reactive drilling force on the cone in the presence of drilling fluid progressively wears away the bushing or bearing surfaces of the cone and the pin and causes an increasingly widening gap between the cone and pin adjacent the lockup groove. Continued drilling with extraordinary clearance between journal and cone causes the cone to wobble erratically and skews the pin and cone axes.

When a predetermined degree of such surface wear has occurred, the upper pin-cone gap is widened sufficiently to permit entry into the lockup groove of one or more of the ball bearings. As the cone rotates one or more of the ball bearings then is forced into the lockup groove by cone wobble and becomes trapped therein. Additional ball bearings cannot be forced past the trapped ones, and become wedged between the trapped balls and the cone. The trapped and wedged balls rotationally lock the cone on its journal pin or at least substantially inhibit rotation of the cone about the pin.

The ball bearings in the rotationally locked cone still retain the cone on its journal pin, thus preventing cone loss while at the same time preventing further pin-cone surface wear which could cause such loss.

The lockup groove thus uniquely functions to prevent wear-induced cone loss and automatically creates a signal indicating that the dulled bit needs to be replaced.

DETAILED DESCRIPTION

Figure 1:
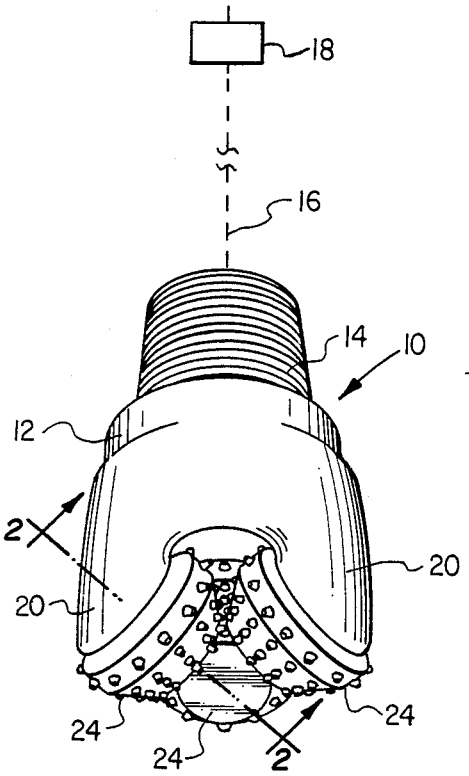
FIG. 1 is a perspective view of a rotary rock bit which embodies principles of the present invention and is connected to the lower end of a schematically depicted drill pipe string rotationally driven by a rotary table.

Illustrated in FIG. 1 is a rotary rock bit 10 which embodies principles of the present invention and uniquely eliminates the cone loss problem heretofor associated with rock bits of conventional construction. The bit 10 has a body 12 having a threaded upper end portion 14 adapted to connect the bit to the lower end of a drill string 16 rotationally driven by a rotary table 18. Dependent from the body 12 are three support arms 20 each of the arms having a journal pin 22 (FIG. 3) which projects downwardly and radially inwardly therefrom. It will be appreciated that while a three cone bit is illustrated, other drill bits having differing numbers of cones are also within the scope of my invention. In other words, my invention is applicable to bits having at least one cutting cone that is supported by a journal pin. Rotatably and coaxially secured to each of the journal pins 22, in a manner subsequently described, is a cutting cone 24. The cutting cone can have a variety of teeth or other cutting elements as a part of the cone. During rotation of the bit 10 the cones 24 rotate relative to their supporting journal pins to thereby provide the bit with its earth-cutting action.

As will be seen, when a seal failure occurs and a predetermined degree of pin-cone surface wear occurs, one or more of the cones 24 is automatically caused to be rotationally locked on its journal pin. It will be appreciated that instead of complete lockup of the cone there may still be some inhibited rotation. This lockup of the cone causes a readily detectable increase in the torque of rotary table 18, and a decrease in the bit's penetration rate, thereby signalling the driller of the necessity to replace the worn bit.

Importantly, this cone lockup automatically occurs prior to an amount of surface wear between any of the cones and their journal pins which might otherwise permit one or more of the cones to be separated from the bit.

Figure 3:
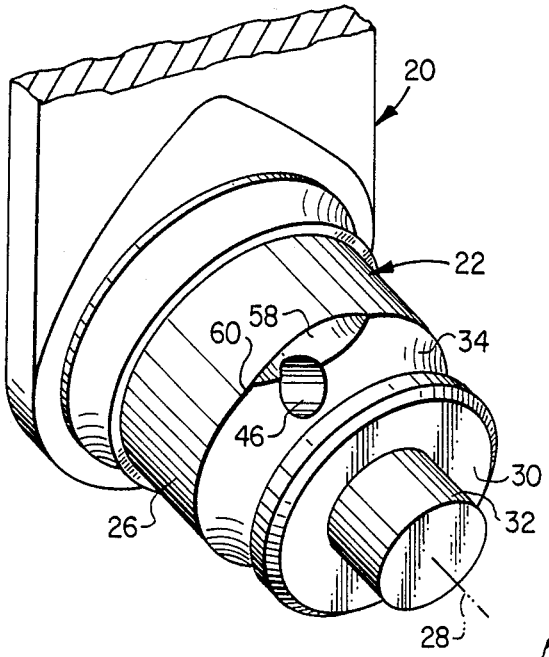
FIG. 3 is a perspective view of the journal pin used to rotatably support the cutting cone in FIG. 2.

Referring now to FIG. 3, each of the journal pins 22 has a journal bearing surface 26, a longitudinal axis 28, an outer end 30, a pilot pin journal 32, and an annular depression in the form of a ball race 34.

Figure 2:
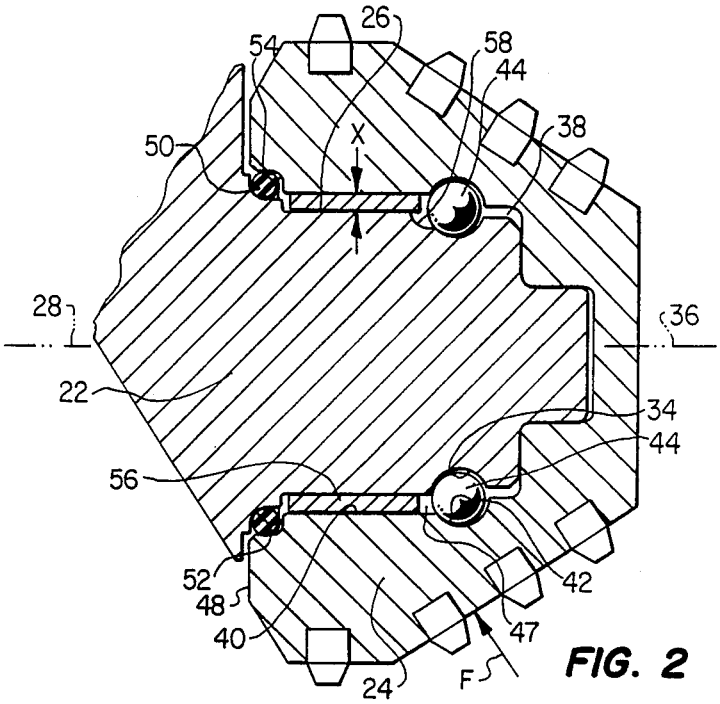
FIG. 2 is an enlarged scale, somewhat simplified cross-sectional view through a cutting cone portion of the bit taken along line 2—2 of FIG. 1.

As illustrated in FIG. 2, each of the cutting cones 24 has a rotational axis 36, a bore 38 which is complementarily configured relative to the journal pin 26, a cylindrical inner surface 40 defined by the opening 38 and an annular ball race 42. The cone opening 38 coaxially receives the journal pin 22 as illustrated in FIG. 2, the pin and cone races 34, 42 being aligned. In the races 34, 42 is an annular array of hardened-steel ball bearings 44 which are loaded into the races through a ball insertion passage 46 extending through the journal pin into the pin race 34 (only an inner end portion of insertion passage 46 being depicted in the drawings). After the balls are loaded in the races, the opening 46 is plugged in a conventional manner.

The ball bearings 44 retain the cone 24 on the journal pin 22. Adjacent the base 48 of the cone 24 is an O-ring seal 50 carried in facing annular grooves 52, 54 formed respectively in the journal pin 22 and the cone 24. O-ring seal 50 functions to prevent bore hole fluid from entering the interior of the cone.

The diameter of the cylindrical inner cone surface 40 is large enough that an annular gap 47, having a width "X", is formed between the pin and cone surfaces 26, 40. Positioned in this gap is an annular floating journal bushing 56 which is formed from a suitable bearing material, such material being softer than the hardened-steel ball bearings. Bushing 56 maintains the pin and cone in axial alignment.

Referring again to FIG. 3, the automatic cone lockup feature of the present invention is provided by means of a small lockup groove or channel 58 formed in the journal pin 22 along the upper portion of the ball race 34 and the journal surface 26. The illustrated groove 58 has a maximum radial depth less than the maximum radial depth of pin race 34 and laterally communicates with the pin race 34. In operation, the groove or channel is on the "unloaded" side of journal pin 22.

During normal operation of the rock bit, the lockup groove 58, which forms a depression in the upper journal pin surface, in no way interferes with or hinders the rotation of the cutting cone 24 relative to its supporting journal pin 22.

Figure 4:
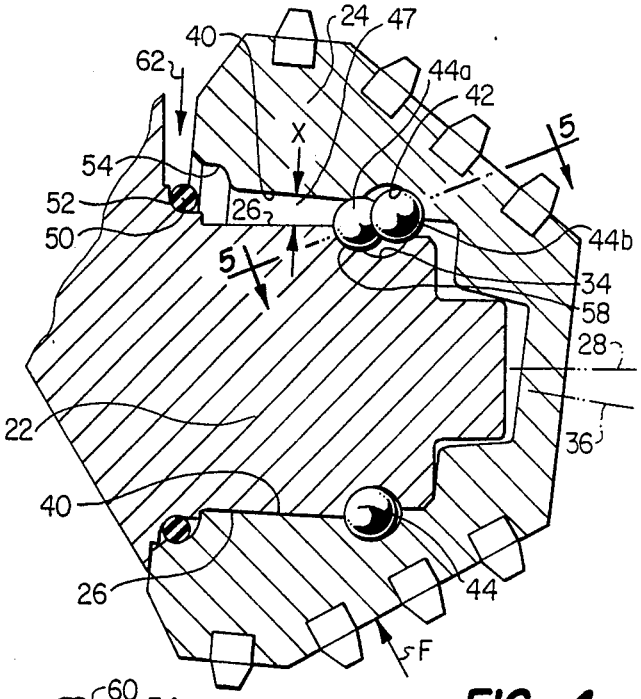
FIG. 4 is a cross-sectional view similar to that in FIG. 2 but depicting the worn cone being rotationally locked on its journal pin by several ball bearings trapped and wedged between the cone and pin.

However, as the bit accumulates drilling time and the seal 50 fails, the upward drilling reactive force "F" and borehole fluid and detritus causes the bushing 56 to progressively wear away, while also causing the cone axis 36 to skew downwardly from the journal pin axis 28 as illustrated in FIG. 4. Eventually the bushing 56 is completely worn away so that lower circumferential portions of the pin and cone surfaces 26, 40 come into contact and wear each other away. This, in turn, progressively widens the gap depth "X" around the upper circumferential portion of the pin 22.

Figure 5:
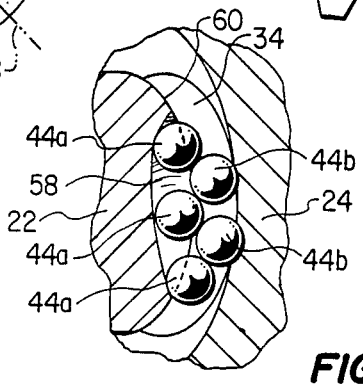
FIG. 5 is a cross-sectional view through the trapped and wedged ball bearings, and adjacent portions of the pin and cone, taken along line 5—5 of FIG. 4.

When a predetermined amount of such surface wear has occurred (and the axes 28, 30 concomitantly skew to a predetermined degree), an upper circumferential portion of the races 34, 42 separate to an extent which permits one or more of the balls 44 (e.g., balls $44_a$ in FIG. 5) to shift axially into and be trapped in the lockup groove 58. Additional balls $44_b$ cannot be forced passed the trapped balls and become wedged between the trapped balls 44*a* and the cone 24. The trapped and wedged balls $44_a$, $44_b$ rotationally lock or materially inhibit the rotation of cone 24 relative to its supporting journal pin 22. The lockup of one or more of the cones 24, as previously mentioned, increases the rotary table torque and decreases the bit's penetration rate, thereby signalling the drill operator that the worn bit needs to be replaced.

It is important to note that after cone lockup the balls 44, which function as lockup members, still retain the cone 24 on its journal pin 22 and prevent cone loss. It can be seen in FIG. 4 that although the upper gap depth "X" has widened sufficiently to permit the axial shifting of balls $44_a$ into the lockup channel 58, this upper gap depth is not wide enough to permit any of the trapped balls $44_a$ to escape from between the cone and pin. Accordingly, the balls 44 still retain the cone 24 on the journal pin 22. Stated in another manner, the trapping and wedging action of the balls $44_a$, $44_b$ automatically occurs prior to an amount of surface wear between the pin and cone sufficient to permit escape of the balls 44.

It should also be emphasized that this rotational cone lockup, unlike cone lockups in conventional rock bits, is not simply a fortuitous event—it automatically occurs in a very consistent and uniformly predictable manner due to the unique incorporation into the bit of the lockup groove 58.

From the foregoing it can be seen that the present invention provides an improved rotary rock bit having incorporated therein a unique automatic cone lockup feature, provided via the lockup grooves 58, which simply and inexpensively eliminates the cone loss problems commonly associated with rock bits ov conventional construction.

The foregoing detailed description is to be clearly understood as given by way of illustration and example only, the spirit and scope of this invention being limited solely by the appended claims.

What is claimed is:

1. A rotary rock bit comprising:

(a) a journal member having an axis and a laterally outwardly facing surface;

(b) a cutting element supported on said journal member for rotation relative thereto about said axis and having a surface circumscribing and facing said journal member surface, said cutting element being retained on said journal member by an annular array of ball bearings; and (c) means, responsive to a predetermined degree of wear occurring during operation of said rock bit, for causing inhibited rotation between said journal member and said cutting element, said means for causing inhibited rotation including means for causing at least one of said ball bearings to shift axially out of said annular array thereof and for utilizing the shifted ball bearing to cause said inhibited rotation between said journal member and said cutting element.

2. The rotary rock bit of claim 1 wherein the last-mentioned means include groove means, formed on said journal member, for receiving and trapping the shifted ball bearing.

3. The rotary rock bit of claim 2 wherein said groove means are disposed on a surface portion of said journal member which faces generally upwardly during use of said rotary rock bit.

4. Rotary rock bit apparatus comprising:

(a) a journal member having an axis;

(b) a cutting element having an axis and coaxially circumscribing said journal member;

(c) means for supporting said cutting element on said journal member for coaxial rotation relative thereto, said means for supporting said cutting element on said journal member including an annular array of ball bearings; and (d) means, responsive to a predetermined degree of skew occurring between said axes, for materially inhibiting rotation of said cutting element relative to said journal member, said means for materially inhibiting rotation including means for utilizing a plurality of said ball bearings to rotationally lock said cutting element on said journal member, said journal member having an annular race coaxially formed thereon and operatively receiving a radially inner portion of said annular array of ball bearings, and said means for materially inhibiting rotation further including a lockup groove formed on said journal member and communicating with said annular race.

5. The apparatus of claim 4 wherein said journal member has an axially extending laterally outwardly facing cylindrical surface, said race is formed in said surface and has an axially inner annular juncture therewith, and said lockup groove is formed along a circumferential portion of said juncture.

6. The apparatus of claim 5 wherein said lockup groove has a maximum radial depth less than the maximum radial depth of said race.

7. The apparatus of claim 6 wherein said circumferential portion of said juncture is generally upwardly disposed during use of said rotary rock bit apparatus.

8. A rotary rock bit comprising:

(a) a cutting element having an opening therein, and an annular race formed in the surface of said opening;

(b) a journal member received in said opening, said journal member having an annular race formed thereon;

(c) an annular array of ball bearings operatively carried in said annular races and captively retaining said cutting element on said journal member; and (d) means, responsive to a predetermined degree of clearance between said races, for materially inhibiting rotation of said cutting element relative to said journal member by axially shifting at least one of said ball bearings out of said races.

9. The rotary rock bit of claim 8 wherein said means for materially inhibiting rotation include a lockup depression formed in said rock bit, said lockup depression being positioned and configured to receive and trap the axially shifted ball bearing.

10. The rotary rock bit of claim 9 wherein said lockup depression is formed on said journal member and communicates with said journal member race.

11. A method of preventing wear-induced dislodgement of a cutting cone from a journal pin of a rock bit, said cutting cone being captively retained on said journal pin by an internal annular array of ball bearings, said method comprising the steps of:

(a) permitting only a predetermined amount of rotationally-induced wear between preselected laterally facing surfaces disposed within said cutting cone, said predetermined amount of wear being below a wear amount sufficient to allow axial dislodgement of said cutting cone from said journal pin;

(b) causing at least one ball bearing to shift axially of said journal pin, and out of said annular array, in response to the attainment of said predetermined amount of rotationally-induced wear; and (c) utilizing the shifted ball bearing to inhibit subsequent rotation of said cutting cone relative to said journal pin.

12. The method of claim 11 wherein said step of causing at least one ball bearing to shift axially is performed by forming a lockup groove in the journal pin and causing at least one ball bearing to axially shift into said lockup groove, and wherein said step of utilizing the shifted ball bearing is performed by trapping the shifted ball bearing in said lockup groove and wedging another ball bearing between the trapped ball bearing and the cutting cone.

13. The method of claim 11 wherein said step of permitting only a predetermined amount of rotationally-induced wear is performed by permitting only a predetermined amount of rotationally-induced wear between laterally facing surfaces of said journal pin and said cutting cone.

14. Rock bit apparatus comprising:

(a) a body;

(b) a support arm depending from said body;

(c) a journal pin projecting outwardly from said support arm, said journal pin having a longitudinal axis, a cylindrical outer side surface, and an annular race coaxially formed in said laterally outwardly facing surface;

(d) a cutting cone having an axis, a central axial opening defining in said cone a cylindrical interior side surface, and an annular race coaxially formed in said interior side surface, said journal pin being coaxially received in said central cutting cone opening with said interior cutting cone surface outwardly circumscribing said journal pin outer side surface and said annular races being axially aligned;

(e) an annular array of ball bearings operatively carried within said races, said ball bearings captively retaining said cutting cone on said journal pin; and (f) groove means, communicating with said annular races, for axially receiving at least one of said ball bearings in response to a predetermined degree of skewing between said axes of said journal pin and said cutting cone during rotation of said cutting cone, and for utilizing the received ball bearing to cause a rotational inhibition between said cutting cone and said journal pin.

15. The apparatus of claim 14 wherein said groove means are formed on said journal pin and define an axial extension of a circumferential portion of said annular race on said journal pin.

16. The apparatus of claim 15 wherein said annular race on said journal pin is adjacent the outer end of said journal pin, and wherein said groove means define an axially inward extension of a circumferential portion of said annular race on said journal pin.

17. The apparatus of claim 16 wherein the radial depth of said groove means is less than the radial depth of said annular race on said journal pin.

18. The apparatus of claim 17 wherein said circumferential portion of said annular race on said journal pin is generally upwardly disposed during use of said rock bit apparatus.

19. The apparatus of claim 14 wherein said annular array of ball bearings is positioned adjacent the outer end of said journal pin, and said rock bit apparatus further comprises:

(g) annular seal means, operatively positioned between said journal pin and said cutting cone adjacent the inner end of said journal pin, for preventing entry of bore hole fluid into said cutting cone, and (h) annular bushing means coaxially disposed between said journal pin and said cutting cone and axially extending between said seal means and said annular array of ball bearings.

20. The apparatus of claim 19 wherein said bushing means are of a softer material than said ball bearings.

21. The apparatus of claim 20 wherein said bushing means comprise an annular aluminum bronze floating bushing, and wherein said ball bearings are of a hardened-steel material.

22. A rotary rock bit comprising:

(a) a journal pin;

(b) a cutting cone captively retained on said journal pin and rotatable relative thereto;

(c) a plurality of locking members carried between said journal pin and said cutting cone; and (d) means, responsive to a predetermined degree of wear between said journal pin and said cutting cone, for causing one or more of said lockup members to shift relative to said journal pin and become wedged between said journal pin and said cutting cone to thereby materially inhibit rotation of said cutting cone relative to said journal pin, said plurality of lockup members comprising an annular array of ball bearings, and said means for causing one or more of said lockup members to shift including means for defining a depression on said journal pin, and means for causing one or more of said ball bearings to shift into said depression on said journal pin.

23. The rotary rock bit of claim 22 further comprising an annular race formed on said journal pin, and an annular race formed on said cutting cone, said annular races operatively carrying said annular array of ball bearings, and wherein said means for defining a depression include a lockup groove formed on said journal pin and communicating with said annular race formed on said journal pin.

24. A rotary rock bit comprising:

(a) a journal pin having a depression formed thereon;

(b) a cutting cone captively retained on said journal pin and rotatably relative thereto;

(c) a plurality of lockup members carried between said journal pin and said cutting cone in said depression; and (d) means, responsive to a predetermined degree of wear between said journal pin and said cutting cone, for causing one or more of said lockup members to shift relative to said journal pin and become wedged between said journal pin and said cutting cone to thereby materially inhibit rotation of said cutting cone relative to said journal pin, said means for causing one or more of said lockup members to shift including means for causing one or more of said lockup members to be displaced from said depression.

25. The rotary rock bit of claim 24 wherein said depression is an annular race formed on said journal pin, and said plurality of lockup members comprise an annular array of ball bearings operatively carried in said annular race.

* * * * *